US006691784B1

(12) United States Patent
Wanvik

(10) Patent No.: US 6,691,784 B1
(45) Date of Patent: Feb. 17, 2004

(54) RISER TENSIONING SYSTEM

(75) Inventor: Leiv Wanvik, Houston, TX (US)

(73) Assignee: Kvaerner Oil & Gas A.S., Lysaker (NO)

( * ) Notice: Subject to any disclaimer, the term of this patent is extended or adjusted under 35 U.S.C. 154(b) by 0 days.

(21) Appl. No.: 10/069,289

(22) PCT Filed: Aug. 21, 2000

(86) PCT No.: PCT/GB00/03363

§ 371 (c)(1),
(2), (4) Date: Jun. 19, 2002

(87) PCT Pub. No.: WO01/16458

PCT Pub. Date: Mar. 8, 2001

(30) Foreign Application Priority Data

Aug. 31, 1999 (GB) ..... 9920540
Apr. 28, 2000 (GB) ..... 0010497

(51) Int. Cl.[7] ..... E21B 29/12

(52) U.S. Cl. ..... 166/355; 166/350; 166/346; 166/367; 405/224.4; 175/8

(58) Field of Search ..... 166/355, 350, 166/359, 367, 354, 346, 352; 405/224.4, 224.2; 175/7, 8, 5

(56) References Cited

U.S. PATENT DOCUMENTS 3,142,343 A * 7/1964 Otteman et al. ..... 175/7
3,390,654 A * 7/1968 Bromell et al. ..... 114/264
3,496,898 A * 2/1970 Morgan ..... 114/294
3,681,928 A * 8/1972 Vincken et al. ..... 405/196
3,721,293 A * 3/1973 Ahlstone et al. ..... 166/355
3,785,445 A * 1/1974 Scozzafava ..... 175/5
3,871,622 A * 3/1975 Larralde et al. ..... 254/392
3,891,038 A * 6/1975 Delestrade et al. ..... 175/7
3,917,006 A * 11/1975 Kellner ..... 175/5
3,919,958 A * 11/1975 Graham et al. ..... 114/264
4,099,560 A * 7/1978 Fischer et al. ..... 166/350
4,215,950 A * 8/1980 Stevenson ..... 405/168.4
4,395,160 A * 7/1983 deJong ..... 405/224.4
4,423,983 A * 1/1984 Dadiras et al. ..... 405/224.2
4,456,073 A * 6/1984 Barth et al. ..... 166/367
4,616,707 A * 10/1986 Langner ..... 166/345
4,694,909 A * 9/1987 Stephenson et al. ..... 166/356
4,753,553 A * 6/1988 Carlsen et al. ..... 405/195.1
4,883,387 A * 11/1989 Myers et al. ..... 405/224.4
4,883,388 A * 11/1989 Cherbonnier ..... 405/195.1
4,934,870 A * 6/1990 Petty et al. ..... 405/199
4,962,817 A * 10/1990 Jones et al. ..... 175/5
5,427,180 A 6/1995 de Paiva Leite et al.
5,846,028 A * 12/1998 Thory ..... 405/195.1
6,343,893 B1 * 2/2002 Gleditsch ..... 405/196
6,431,284 B1 * 8/2002 Finn et al. ..... 166/350

FOREIGN PATENT DOCUMENTS

EP 0 390 728 10/1990

* cited by examiner

*Primary Examiner*—Robert E. Pezzuto
*Assistant Examiner*—Thomas A. Beach
(74) *Attorney, Agent, or Firm*—Young & Thompson

(57) ABSTRACT

In a substructure (10) for a floating oil or gas production platform, an arrangement to tension a plurality of risers (16) extending from the sea bed up to the substructure, the arrangement comprising: a conventional hydraulic tensioner/heave compensator (17) for each riser, in which there is a soft spring formed by a piston cylinder combination acting against an accumulator, the heave compensators for the risers being disposed to compensate for vertical oscillations of relatively short period (e.g. from 1 second to about 5 minutes) between the risers and a vertically adjustable Xmas tree deck (18); and a vertical position adjustment system (21/22) capable of intermittent operation to adjust the vertical position of the Xmas tree deck (18) relative to the floating substructure (10) to compensate for longer term changes which would otherwise cause the individual riser's tension or stroke position to depart from its target value/range; the Xmas tree deck vertical position adjustment system being normally located in one particular position within its range of movement to compensate for the longer term changes.

34 Claims, 8 Drawing Sheets

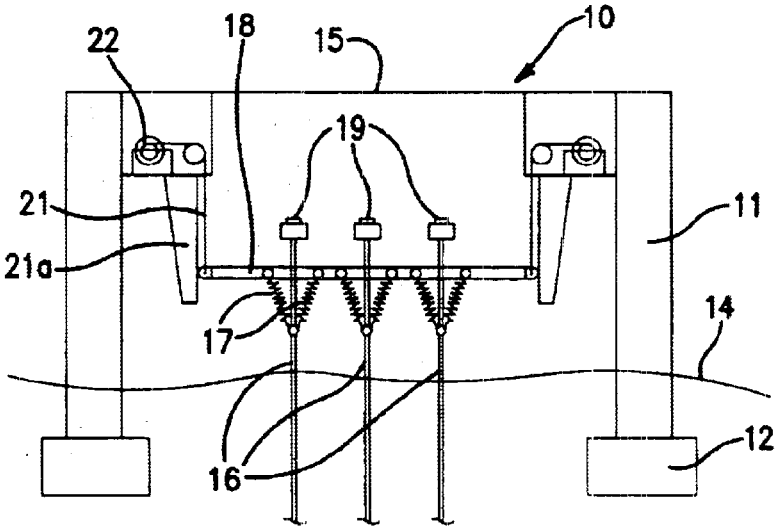
FIG. 1
FIG. 1A
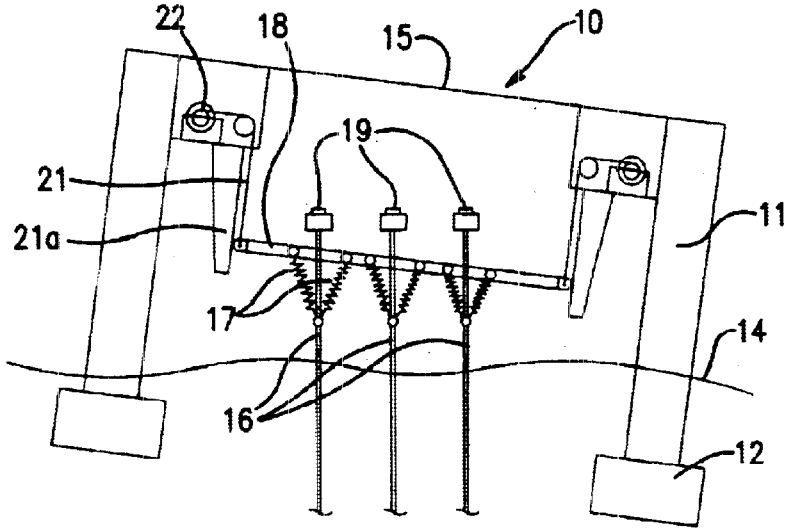
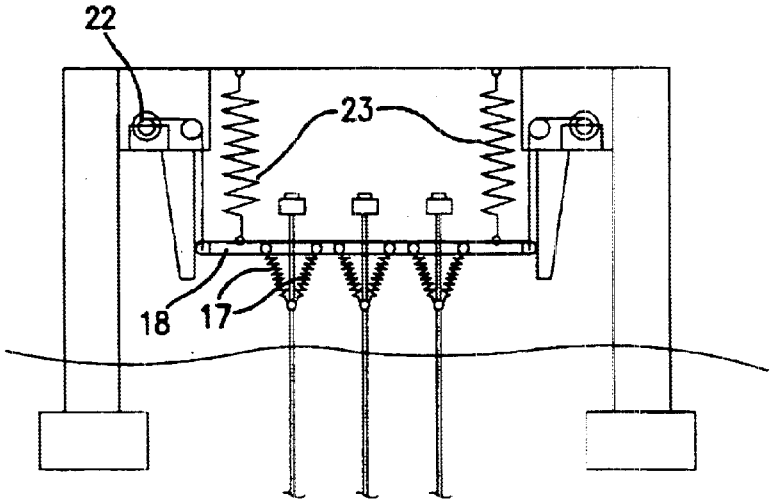
FIG. 2

RISER TENSIONING SYSTEM

TECHNICAL FIELD OF THE INVENTION

The invention relates to a riser tensioning system for a floating oil or gas production platform.

In particular, the invention relates to a riser tensioning system for use on a deep draft floating production facility of the type illustrated in PCT Application WO99/10230. However, the invention could also be used on other floating platforms.

BACKGROUND OF THE INVENTION

Oil and gas production is taking place in progressively deeper water. In water depths up to about 300 m in the North Sea and about 400 m in the Gulf of Mexico, fixed platforms have been used. In deeper water depths, floating platforms are necessary. Production has taken place from ship shaped vessels, column stabilised semi-submersible vessels, floating spars and tension leg platforms (TLPs).

In all cases, near vertical pipelines bring the oil (or gas) up from the sea bed to the floating platform for processing and onward transmission. These near vertical pipelines are known in the offshore industry as 'risers'. A problem exists in that risers need to be held constantly in tension against vertical motions ('heave') of a floating platform. If the risers are allowed to go into compression, buckling may occur. Thus it has been necessary to use heave compensators to keep the risers under tension.

In water depths greater than 1500 m, the heave period becomes a problem for TLPs. Deep Draft Floaters (DDFs) have smaller motions than conventional semi-submersible vessels, but larger motions than TLPs.

In some floating platforms, such as in 'spar' platforms, it has been known to use external buoyancy cans to tension the risers. This technique is described in U.S. Pat. No. 4,702,321. Tensioning with external cans has several drawbacks. The risers are confined in a central vertical duct. Damage from fatigue may be experienced by the risers due to uncontrolled 'piston' actions from buoyancy cans and excitation of various modes of vibrations, as well as uncontrolled sticktion phenomena. This may lead to rupture and consequential leakage, fire and explosion with resulting damage to the topside facilities and to other risers. This makes caisson type vessels especially vulnerable. In these vessels, the leakages pass up through the caisson well into the middle of the topside deck installation. TLPs do not have this disadvantage as their risers are suspended freely in the water. In most cases a leakage in the riser system will be dispersed from the TLP by water currents and winds at the surface.

In principle, it is possible to extend (lengthen) tensioner systems developed for TLPs to accommodate the larger heave motions which are likely to be experienced by risers on DDFs and other vessels. However, this creates practical difficulties.

DDFs have slightly less air gap than TLPs between their lowest deck and the sea surface, because there is no "pull-down" from the tethers as the TLP moves off its nominal position. The same effect increases the need for riser "pay-out" for a DDF for the same displacement Additionally, for DDFs, there is a contribution from their significantly larger heave motions. To allow for this larger pay-out/pay-in of risers, (often referred to as heave compensation), the traditional 'pulling cylinder' design of heave compensator would become so long that under normal operation, the 'tensioner ring' would be partly below water level. The tensioner ring is an assembly connecting the tensioner rods of the heave compensator to the riser. If the tensioner ring is partly below water, this critical connection is difficult to reach for inspection.

To raise this critical connection to above sea level, it would be necessary for the tensioner rods to be longer, so that they would extend up through the deck opening. This would lead to a complex arrangement, with a risk of potential clashes, or loss of valuable area on the production deck or drilling equipment deck. Another expedient for raising the tensioning ring would be to invert the tensioner system, so that it had a 'rods up' configuration. This would increase the Xmas tree height above the tree deck; lead to instability in shear and torsion; and possibly lead to a compression/buckling problem with the inverted tensioner rods.

In any case, the tensioner stroke necessary for such longer tensioner systems could be beyond what is practical, reliable and cost effective.

Thus there is a requirement for a riser tensioning system which would be applicable to vessels with larger heave motions than TLPs, and which would avoid the practical difficulties outlined above.

DISCLOSURE OF THE INVENTION

The theoretical background to this invention is described in OTC Paper 11904 (published at Houston Tex. in May 2000).

The invention provides, in a substructure for a floating oil or gas production platform, an arrangement to tension a plurality of risers extending from the sea bed up to the substructure, the arrangement comprising:

i) a conventional hydraulic tensioner/heave compensator for each riser, in which there is a soft spring formed by a piston cylinder combination acting against an accumulator, the heave compensators for the risers being disposed to compensate for vertical oscillations of relatively short period (e.g. from 1 second to about 5 minutes) between the risers and a vertically adjustable Xmas tree deck, and ii) a vertical position adjustment system capable of intermittent operation to adjust the vertical position of the Xmas tree deck relative to the floating substructure to compensate for longer term changes which would otherwise cause the individual riser's tension or stroke position to depart from its target value/range; the Xmas tree deck vertical position adjustment system being normally located in one particular position within its range of movement to compensate for the longer term changes.

In the foregoing, examples of the relatively short period oscillations referred to in i) are the first order wave motions and normal operational state surge, sway and pitch slow drift oscillations. Examples of the longer-term changes referred to in ii) are an extreme quasistatic horizontal offset caused by severe storm conditions, extreme overlaid oscillations at the critical surge/sway period of the moored substructure (slow drift), or inadvertent flooding of one of the buoyant compartments of the substructure.

It is preferred that the vertical position adjustment system includes stiff hydraulics (in which pistons may be hydraulically locked) which Interconnect the Xmas tree deck and the substructure.

It is further preferred that hydraulic oil is supplied from pressurized accumulators when raising the Xmas tree deck, and bled to a tank when lowering the Xmas tree deck.

In one preferred form the Xmas tree deck has counterbalance means, such that its vertical movements to compensate for longer term changes are counterbalanced, and only minimal force is required to effect vertical movement.

In this form it is preferred that the Xmas tree deck vertical position adjustment system comprises at least three piston cylinder and accumulator combinations acting between the Xmas tree deck and the floating substructure, and in which the three combinations are synchronised to avoid excessive tilt of the Xmas tree deck relative to the substructure.

It is further preferred that the cylinders in the combinations are connected to a single accumulator, so that the Xmas tree deck is sensibly horizontal, and in which there is a rack and pinion mechanism which engages with the substructure to maintain parallellity of the moving X-mas tree deck with the substructure at all times, where rack and pinions engage at least two faces of the deck, at right angles.

In this form it is alternatively preferred that the vertical position adjustment system comprises at least three pulley systems acting between the Xmas tree deck and the substructure, and in which the pulley systems are powered to compensate for longer term vertical changes.

It is further preferred that a part of each pulley system is engaged by a further piston cylinder combination.

The pulley systems may be powered by hydraulic or electric motors for synchronous movement.

In forms of the invention wherein the Xmas tree deck has counterbalance means, it is preferred that there is means whereby synchronism can be effected by hydraulic valve logic while the vertical position adjustment system is moving.

It is further preferred that a locking provision on the vertical position adjustment system is arranged to become unlocked when a heave compensator is approaching the end of its stroke.

It is still further preferred that predetermined high and low pressures in the heave compensators are arranged to open valves between the piston cylinder combinations and the accumulators in the vertical position adjustment system.

In another form of the invention, it is preferred that the vertical position adjustment system includes mechanical engagement devices which interconnect the Xmas tree deck and the substructure.

In any of the forms of the invention described above, there may be a control system which has provision for the arrangement to operate without human intervention (e.g. in circumstances in which the floating oil or gas platform is temporarily de-manned during a hurricane).

It is preferred that the control system includes a program to adjust the elevation of the Xmas tree deck in response to stroke measuring devices on at least three of the individual heave compensators, whereby, at preset limits of compensator stroke, the vertical position adjustment system moves the Xmas tree deck in a sense towards the limit reached on the individual heave compensator.

It is further preferred that the spring rates of the individual heave compensator are increased near both the limits of travel of the individual heave compensators, such that the equilibrium of the balanced Xmas tree deck will be changed so that the Xmas tree deck moves towards the applicable limit of travel under the action of the vertical position adjustment system.

In any of the forms of the invention described above, the balanced vertical position adjustment system under mean force equilibrium may be normally retained by frictional forces in one particular position within its range of movement, and is moved intermittently in direct response to one or several of the heave compensators approaching a limit of operation.

It is preferred that hydraulic cylinders in the vertical position adjustment system are pre-pressurised, so that the system acts as a precompressed spring which fails to 'safe' if the active drive systems lose pressure.

It is further preferred that the heave compensators have an increased vertical spring stiffness as they approach the ends of their stroke ranges.

Preferably, there is adjustment means to change the characteristics of individual heave compensators, so that both the heave compensators for the risers and the vertical position adjustment system for the Xmas tree deck approach their limits of operation at the same time.

In any of the forms of the invention described above the Xmas tree deck may have an integral deck centralisation system.

It is preferred that the Xmas tree deck is supported on at least four pairs of vertical position adjustment systems disposed generally symmetrically about the deck, whereby to centralise the deck within a generally horizontal aperture in the substructure, such that individual heave compensators react lateral loads from individual risers into the Xmas tree deck, and the Xmas tree deck as a whole is centralised within the horizontal aperture.

It is further preferred that vertical rods guide the Xmas tree deck within the horizontal aperture, or that projections from the Xmas tree deck engage vertical guide rails surrounding the horizontal aperture, or that there are pinions on the Xmas tree deck arranged to engage vertical racks round the horizontal aperture.

In a form in which there are pinions, it is further preferred that resilient means are disposed to hold the pinions in engagement with the racks.

In any one of the forms of the invention described above the vertical position adjustment system for the Xmas tree deck may have a generally central slot occupied by dillstring riser tensioner, so to facilitate drilling/workover.

The Xmas tree deck may be used as a foundation for a drilling riser tensioner, or for a workover drillstring tensioner.

Conveniently, hoses from individual Xmas trees on the Xmas tree deck are led through individual downwardly opening trumpet sleeves dependant from a platform above the Xmas tree deck.

Optionally, there are several individual bays of deck grid systems placed onboard the substructure to reduce the pitch differential across the riser array.

Advantageously, there is provision to lock off the vertical position adjustment system for the Xmas tree deck, whereby to adjust the vertical heave stiffness of the substructure.

The invention includes a substructure for an oil or gas production platform, and having an arrangement as described above.

The invention also includes a method of controlling the tension in risers extending from the sea bed up to the hull of a substructure for a floating oil or gas production platform, using the arrangement as described above.

BRIEF DESCRIPTION OF THE DRAWINGS

Some specific embodiments of the invention (and some variants thereof) will now be described by way of example with reference to the accompanying drawings, in which:

FIGS. 1, 1*a* and 2 are diagrammatic side elevational views of a substructure for a floating oil or gas production platform, showing riser tensioning systems, where FIG. 1*a* illustrates the effect of pitch or heel;

DESCRIPTION OF SPECIFIC EMBODIMENTS

Figure 3:
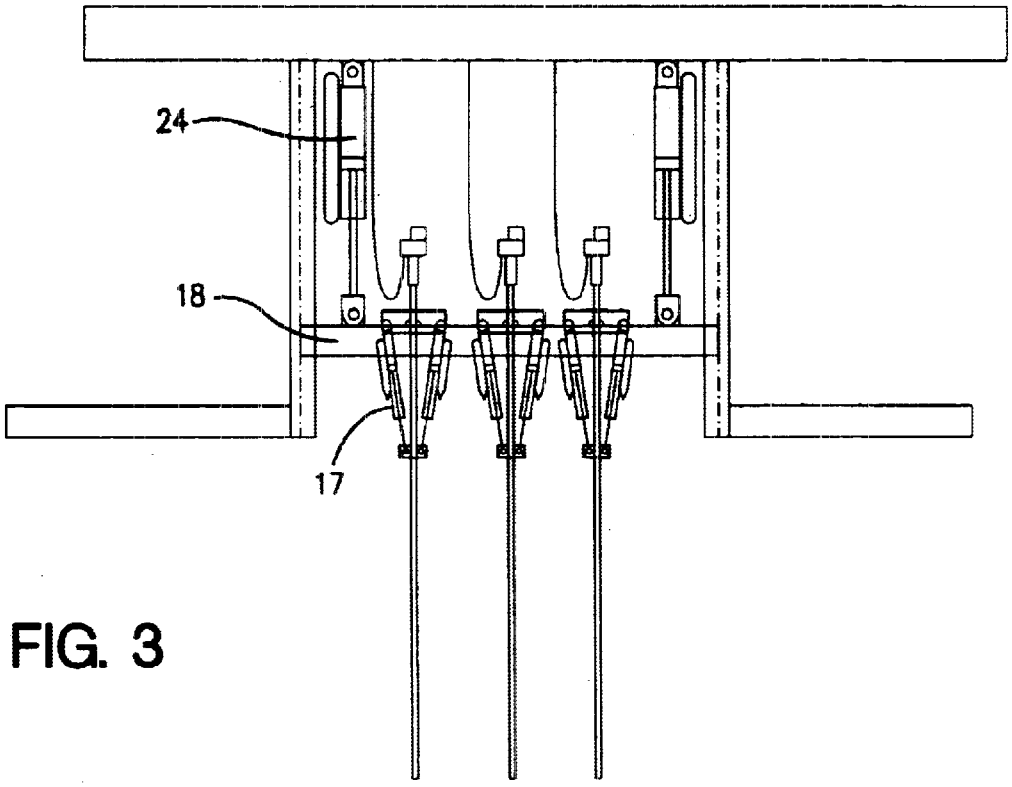
FIGS. 3 and 4 are diagrammatic side elevational views (to an enlarged scale) of Xmas tree decks incorporated in the substructures of FIG. 1 or FIG. 2.

FIG. 1 shows a substructure 10 for a floating oil or gas production platform. The substructure has a set of legs 11 (only two of which are shown) upstanding from pontoons 12. The substructure 10 floats with its pontoons 12 below the sea level 14. The substructure has a main deck 15 for facilities or 'topsides' (not shown).

The substructure is subject to various 'ship motions' (such as heave, surge, sway, pitch, roll, and yaw), and slower oscillations due to reactions of the mooring system—these can be referred to as cyclic motions.

Other motions can be categorised as slowly acting or discrete motions. These include longer term displacements caused by storm surges, offsets caused by currents and the long term effects of wind and wave, and changes in draft caused by e.g. damage to a compartment leading to flooding, or to mooring line failure. These motions can produce both riser stroke variations of relatively short period, and also longer-term changes like a change in draft or sea level changes relative to the sea bed.

For a DDF (as illustrated in WO99/10230) the cyclic motions may create a need for riser stroke compensation in the range of 2.5 m to 3.5 m depending on local environmental conditions. These oscillations can take place continuously over long periods and will include slow drift components under normal operating conditions. Longer-term variations may under extreme conditions necessitate stroke adjustment in the order of 6 m to 8 m, but will take place at rare intervals e.g. twice a during a design storm.

Oil or gas from subsea wells is brought up to the platform by risers 16. The lower ends of the risers (not shown) are fixed to wells on the sea bed. The upper ends of the risers are supported in heave compensators 17, which are mounted below an Xmas tree deck 18. The risers 16 lead to Xmas trees 19 standing on the deck 18.

Following the invention, the position of the Xmas tree deck 18 is arranged to be moveable vertically with respect to the substructure. Vertical movement is represented in FIG. 1 as being effected by direct mechanical connections 21 to prime movers 22. This movement could alternatively be effected by mechanisms generally similar to those used to operate the legs of jack-up platforms. A substructure mounted guiding system 21*a* is shown for the Xmas tree deck 18.

The principle of operation is that short period oscillations are ideally compensated by the heave compensators 17, while the effects of longer term changes can be counteracted by vertical movement of the Xmas tree deck 18.

FIG. 1*a* shows the working principles of the arrangement when the substructure is subject to angular displacements (pitch/roll/heave). The risers 16 will remain near vertical and the heave compensators 17 will have to produce differential strokes across the Xmas tree deck 18 in order to maintain a constant tension. The deck 18 will always remain parallel to its environment Differential strokes may also be caused by the well layout pattern at the sea bed being different from the well pattern on the Xmas tree deck.

It will be understood that there are connections 21 at each corner of the Xmas tree deck 18; and that the operation of these connections is synchronous to avoid tilt of the deck 18. The connections 21 can be locked in one particular vertical position within their overall range of vertical operation.

FIG. 2 shows a variant of FIG. 1, in which the Xmas tree deck 18 is suspended in a counter balanced mode by diagrammatic springs 23. This has the effect of reducing the power required in the prime movers 22 to move the Xmas tree deck vertically. Heave compensators 17 ideally compensate for short-term oscillations as before, as well as for angular displacements (pitch/roll/heel/list)

Figure 4:
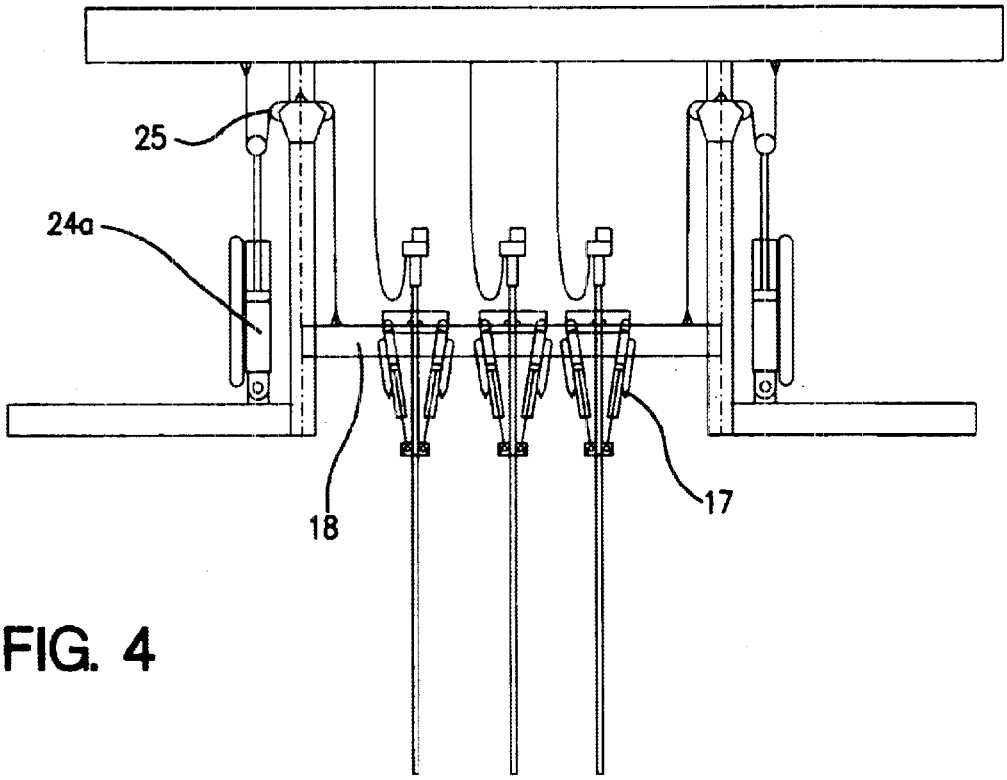

FIG. 3 shows in more detail the arrangement of the heave compensators 17 and the vertical position adjustment systems, as shown in FIGS. 1 and 2. In this case cylinders 24 are connected to pneumatic accumulators (gas over oil—not shown) to balance the system for easy vertical movement. (In another form, control of the balanced system could be effected by a rack and pinion drive.) In FIG. 4 the stroke required of the cylinders 24A is reduced by using a pulley system 25.

With the arrangements shown in FIGS. 3 and 4, the cylinders 24/24A may be shut off to lock the Xmas tree deck 18 in a particular vertical position. Alternatively, the locking may be effected mechanically. Synchronism of the cylinders at the four comers can be effected by hydraulic valve logic when the system is in operation.

In accordance with a feature of the invention, the cylinders 24/24A can be brought into operation automabcally when the heave compensators 17 are near the end of their stroke in one sense or the other. Automatic operation may be appropriate if the platform has to be temporarily abandoned while in the path of a storm. Pressure controls in the heave compensators 17 can be arranged to open up valves automatically, to operate the cylinders 24/24A and their associated accumulators.

Figure 5:
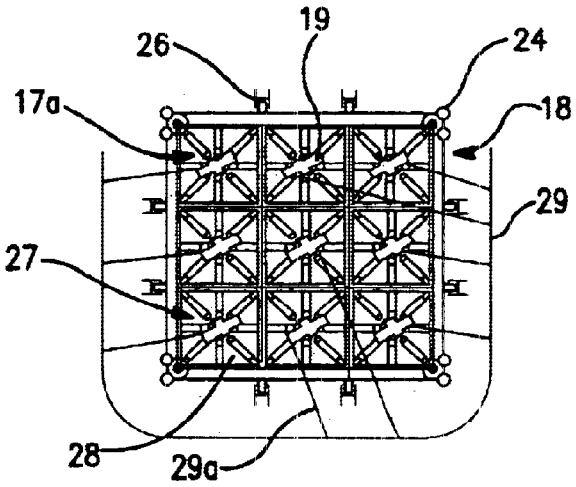
FIGS. 5, 5*a* and 5*b* are a plan views of an Xmas tree deck and details.
Figure 5A:
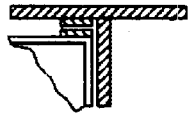
Figure 5B:
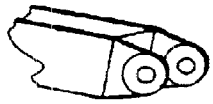

FIG. 5 shows details in plan of the arrangements illustrated in FIGS. 3 and 4. The Xmas trees are disposed in a three by three array. Cylinders 24 are located at the corners of the Xmas tree deck 18. Structural guides 26 (detailed in FIG. 5A) constrain the deck 18 for vertical movement relative to the substructure. Each well has a TLP type heave compensator 27 with four cylinders 28. A manifold 29 is shown (diagrammatically) receiving the production from the wells via flexible hoses 29A (in a manner known from TLPs). The load on the deck 18 could consist of tension on nine risers (at 0.98 MN each) amounting to 9.81 MN, the weight of the heave compensators totaling 2.4 MN, and the weight of the deck 18 at 3.45 MN, adding up to 13.35 MN.

Figure 6:
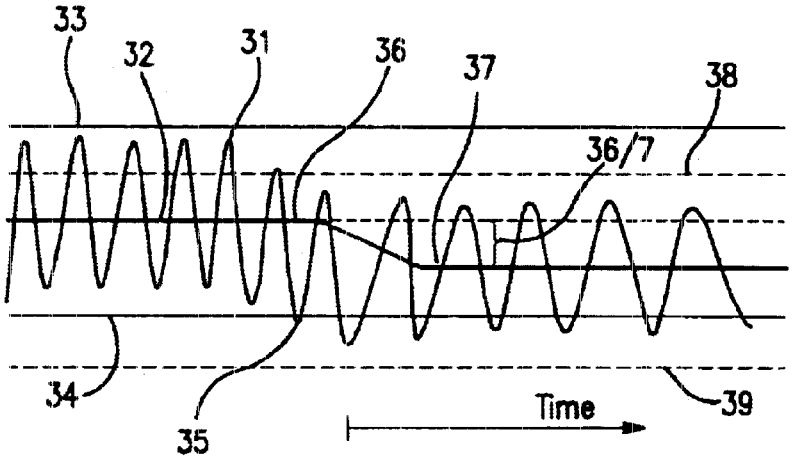
FIG. 6 is a disturbance/time graph illustrating operation of the invention.

A simplified time history of operation of the combined arrangement is shown graphically in FIG. 6. Responses are based on detected heave only but may be driven partly by coupled pitch effects. The trajectory of a typical riser measured at the tensioner ring is designated 31; and the intermittent movement of the vertical position adjustment system is designated 32. Initially the heave compensator operates between upper and lower thresholds, designated 33 and 34. When, due to a combination of oscillations and longer term changes, the down stroke of one heave compensator passes the lower threshold at 35, the vertical position adjustment system is brought into operation. This moves by a predetermined incremental value from 36 to 37, setting up new upper and lower thresholds 38 and 39. Note that the thresholds 33/34 and 38/39 will fluctuate as a function of the pitch/heel angle. Large pitch angles will lessen the effective heave compensator stroke available before crossing set thresholds, as parts of the stroke will be reserved for compensation of the pitch/heel action. The objective of the switching logic would be for the heave compensators 17 always to be operating in their 'mid stroke' position. Each time the possibility of 'bottoming out' is detected in one of the comer compensators (e.g. 17A in FIG. 5), the vertical position adjustment system would effect a shift of say 1.5 m.

The vertical positioning system may contribute to increased overall system redundancy. The vertical position adjustment system may be designed to operate whenever there is a calculated possibility of one of the heave compensators 17 over stroking. Secondly, the vertical position adjustment system would operate should one heave compensator 17 fail/loose tension. In the case of a typical low probability failure—like a double failure induced loss of hydraulic power (burst hoses) on a heave compensator—the Xmas tree deck 18 can be designed to move vertically until a minimum riser tension is restored for the failed heave compensator. The implication would be a slightly increased tension on the remaining intact heave compensators and narrowing in effective thresholds for engaging the vertical positioning adjustment system, since the heave compensators 17 would have less net stroke capacity available in this mode. Thirdly, if there were any possibility of compression occurring in a riser 16, the Xmas tree deck 18 would be raised until tension was ensured. The above scenario accounts for rare events (at accidental probabilities) and may not account for all eventualities. Possible impact loads from failing heave compensators (overstroking or bottoming out) will normally happen close to the extreme of a displacement of the stroke, which means that the velocities will be low, giving relatively minor impact loads, or sufficient time for the system to respond to avoid impact.

Figure 7:
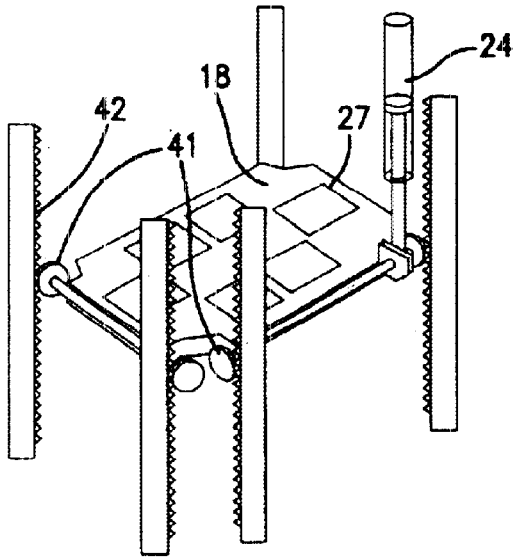
FIG. 7 is an isometric illustration of a vertical position adjustment system forming part of the invention.

A diagrammatic view of the Xmas tree deck 18 is presented in FIG. 7. This illustrates a possible mechanical deck adjustment control system. The Xmas tree deck 18 can be arranged with an active drive and/or synchronization system to control the Xmas tree deck motion and parallelity with its environment at all times. A rack and pinion system shown as 41/42 could be designed as a passive slave system (with the deck riser load carried by another system not shown); or it could be a powered system driven by hydraulic cylinder 24 or direct acting electrical/hydraulic powered motors (not shown). Rack and pinion gears 41/42 will provide the deck parallel synchronization (with two racks at right angles as a minimum) and will at the same time give vertical guidance.

Basic operation of the vertical position adjustment system would be possible with stiff independent hydraulics. These can operate in a synchronous manner given sufficient hydraulic power. To save on power needed to drive the hydraulics, pressurised accumulators could be connected with the cylinders to lift the deck 18 during circumstances leading to power peaks. Downward motion would be effected by bleeding hydraulic fluid to a buffer tank.

A further advantage would be gained by arranging a counterbalanced or 'weightless' deck. In this case the hydraulics would be fully balanced on cylinders with pressure supplied from accumulators, and could be set manually each time the load on the deck 18 changed. Load cells could be used to detect individual loads. A rack and pinion drive could be used in this case to control deck guiding and parallellity with its environment at all times, but also for active driving of the balanced deck. The system could be configured so that the cylinders remain fixed until a stroke measuring and surveillance system on the heave compensators invokes en active repositioning of the active deck drive mechanism. Alternatively, the balanced deck can be designed such that a global tension drop/increase across the entire deck 18 will build up the necessary delta force to get the deck to move from the close to constant pressure of the accumulators. In this case the heave compensators would beneficially be designed to work on a non-linear (hardening spring) characteristic. This might be advantageous in a non-manned (hurricane) condition, as the entire system will be passive, with no active control system.

Another example of the invention will now be described, with reference to FIGS. 8 to 15.

In this example, a ten well system has been considered for the selection of equipment in a 915 m water depth. This system has ten risers 116 arrayed around a three by four matrix, with each riser having a 1.34 MN null tension. This example has been developed extensively, and will be explained in detail. The same theory applies for deeper water depths. The requirements and equipment selection for 2133 m of water (with nominal riser tensions of 4.45 MN) are practical with current hardware.

Figure 8:
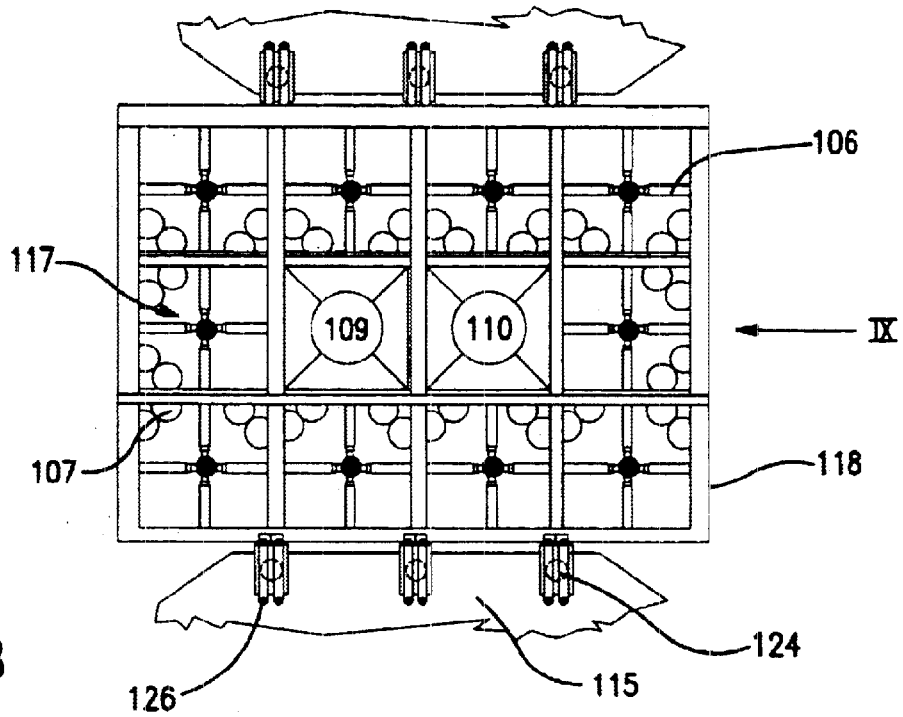
FIG. 8 is a plan view of another embodiment of the invention.
Figure 9:
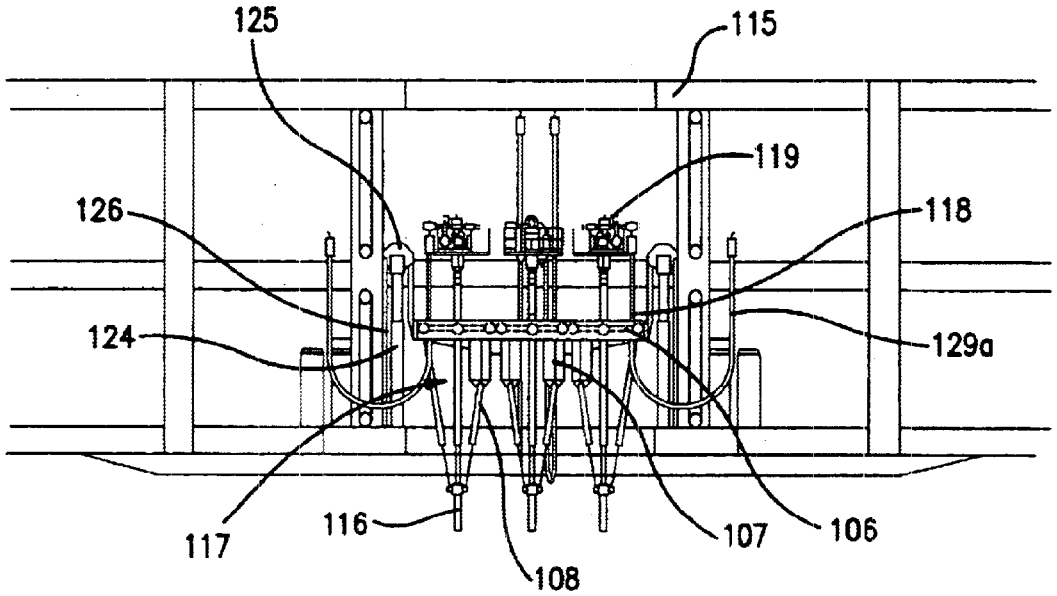
FIG. 9 is a view on arrow IX in FIG. 8.
Figure 10:
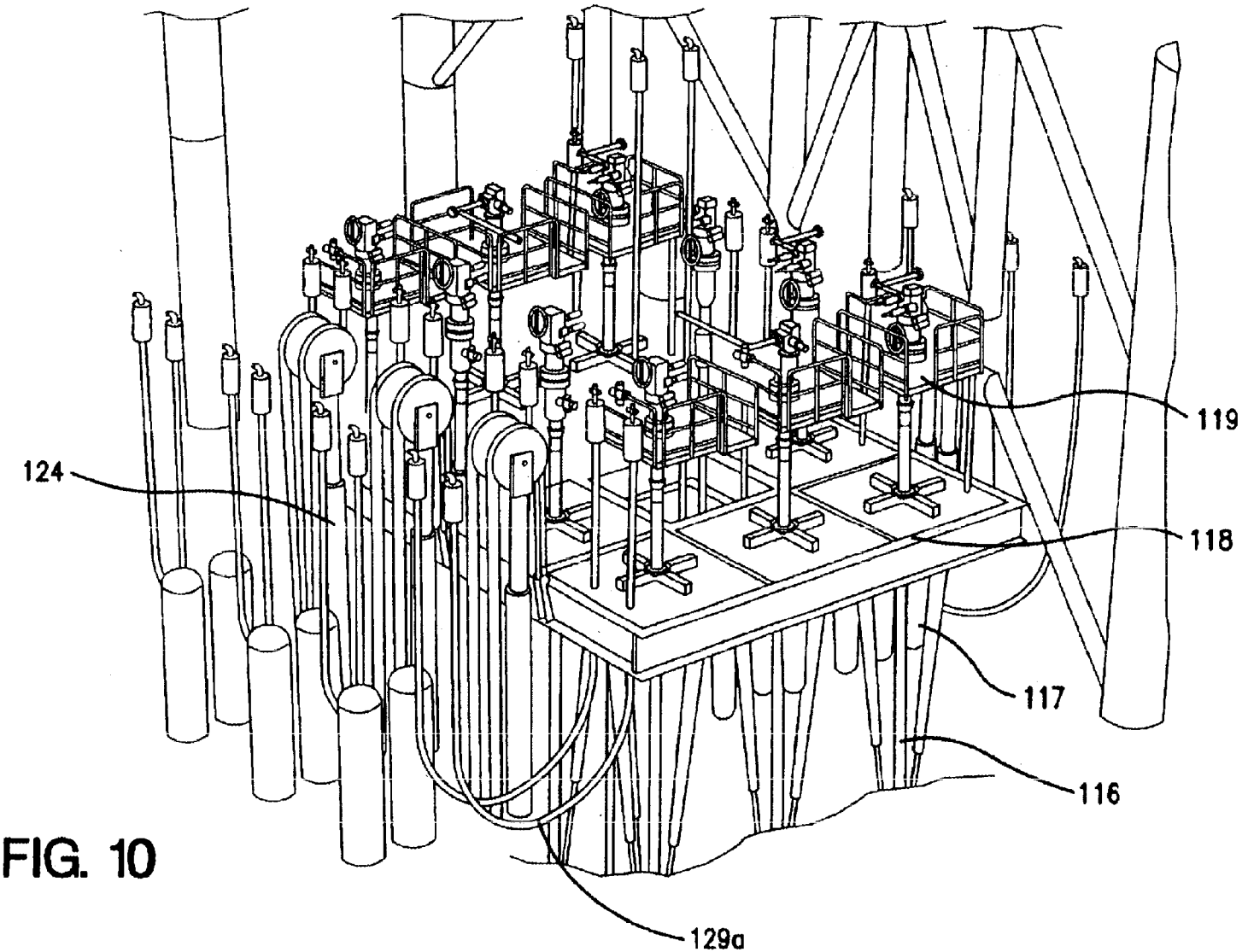
FIG. 10 is an isometric view of the same embodiment.

FIGS. 8 and 9 show two basic spring components for a two-tier riser tensioner system. These components comprise traditional heave compensators 117 (HF); and ram style Xmas tree deck support cylinders 124 (LF). (The cylinders 124 form a vertical position adjustment system.) These two spring components coupled in series address the riser motion requirement for a floating substructure, in this case a DDF. The other major component of the system is the Xmas tree deck 118 and integral centralizing system. Xmas trees 119 are located on the deck 118. Flexible hoses 129A are connected to the Xmas trees.

Some of the parts illustrated in FIGS. 9 to 12 are proprietary items designed by Hydralift Inc. No claim is made to these individual items in the present application.

The HF system operates continuously to accommodate the first order riser motions. This is a conventional heave compensator system with 3.81 m of stroke. This stroke length was selected to account for 1.52 m of vertical riser upstroke, 2.13 m of vertical riser downstroke and maximum anticipated 2 degrees of angular riser displacement (inside the Xmas tree deck). Ten heave compensators 117 are arranged around the outside slots of the three by four well bay matrix. The two inside slots (109,110) are reserved for well workover or ROV operations. As shown in FIG. 9, each heave compensator 117 has four tensioner elements, each comprising a cylinder 108, an accumulator bottle 107, and a riser centralizer arm 106 attached to the Xmas tree deck 118.

Each tensioner element 106–108 is independent and consists of a cylinder connected directly to a dedicated gas expansion accumulator. The cylinder blind end is suspended from a single point on the deck structure with the cylinder rods connected directly to the production riser spool joint. A total of 1.34 MN is to be transferred from the risers 116 into the Xmas tree deck 118 at each well bay slot. Gas expansion accumulators are placed on the deck 118. They are positioned on one side of the well bay to allow the well tree's flow lines to loop through the deck to a common pipe header fixed to the DDF. Four riser centralizers 106 are integrated into each well bay slot to fix the riser in the center of the slot.

The accumulators, charged to a pressure of 12.2 MPa, act within the annulus of a cylinder with a 216 mm I.D. bore and a 102 mm O.D. rod, to produce the required null riser tension of 1.34 MN. The 0.72 m3 capacity accumulators result in a heave compensator stiffness of 72.0 kN/m from the null position to the full downstroke position. Therefore, all ten heave compensators combine to generate a total HF system stiffness of 720 kN/m when stroking out.

During emergencies, the heave compensators 117 are designed to operate at the required tension ranges using only three of their four tensioner elements 106–108. This approach insures that when three cylinders 108 are operating, full tension can be supported without exceeding the maximum rated design pressure of 21 MPa at the full downstroke position. The cylinder bore size is selected to optimize the pressure rating of the cylinder per unit weight of the tensioning element.

Figure 11:
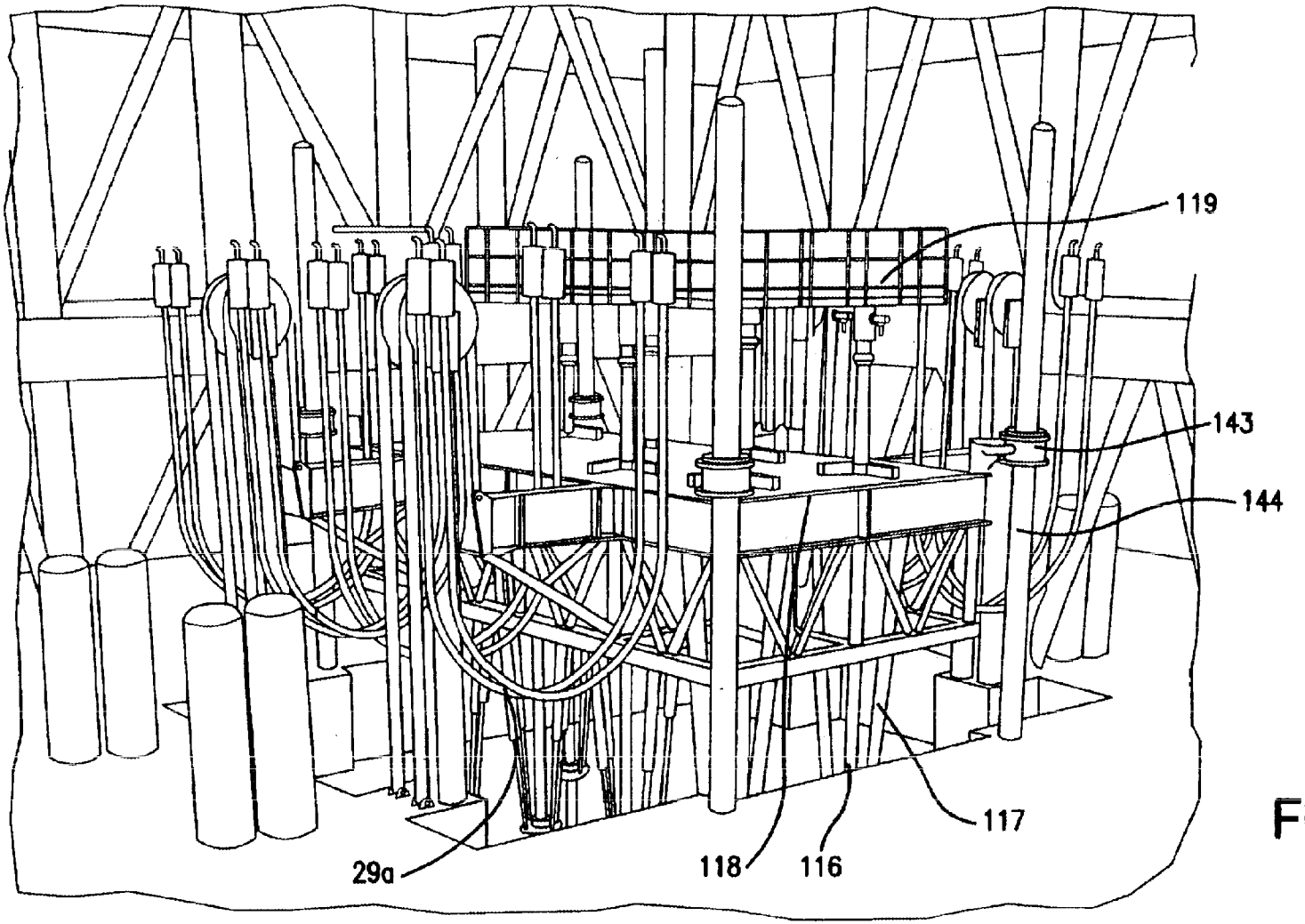
FIG. 11 is another isometric view of that embodiment.

The LF System operates only when necessary, in response to large low frequency displacements or discrete events. A total stroke range of 8.84 m is chosen to accommodate all LF motion requirements. This overall vertical stroke length is broken down to 3.96 m of upstroke and 4.88 m of downstroke. As shown in FIG. 11, traveling guides 143 constrain the Xmas tree deck 118 on fixed vertical guides 144.

To support the Xmas tree deck 118, twelve ram type cylinders 124 are arranged in six pairs. Three pairs are located along one side of the matrix that has four well slots. Three more pairs are located directly across the matrix, to produce a balanced support of the Xmas tree deck. Each cylinder 124 is independent and is connected directly to a dedicated gas expansion accumulator. A collar is designed into the rod end of each cylinder and is supported by structure tied back into the main well bay of the DDF. The cylinders 124 operate in a rod up configuration with a chain sprocket 125 attached to the end of the rod. A support chain 126 is terminated at the cylinder support structure, runs up and over the chain sprocket, then down to terminate at the Xmas tree deck 118. This arrangement could be considered as similar to a drilling riser tensioner with only two parts of wire or chain. This configuration results in a compact arrangement to maximize the vertical travel of the Xmas tree deck.

Standard ram cylinders 124 with 4.42 m of stroke generate the required 8.84 m of platform travel. The gas expansion accumulators are mounted in pairs along the inside walls of the main well bay. Rollers or bearings are mounted in each corner of the Xmas tree deck 118 to react against the centralizing support structure in the main well bay of the DDF. All lateral loads generated by the risers 116 are reacted individually by the heave compensator centralizers into the deck 118; then, as a whole, the deck 113 is centralized within the main well bay of the DDF.

The cylinders 124 are designed to support the following summation of loads: the deck structure, the weight of ten heave compensator systems with fluid, the maximum riser loads that are generated by ten risers at the full heave compensator downstroke position and half the weight of ten full production flow line hoses. To accomplish this, the accumulators are charged to a pressure of 14.6 MPa acting within each cylinder with a 470 mm I.D. bore and produces a total null support chain tension of 15.1 MN. The 1.5 m3 accumulator capacity results in an Xmas tree deck LF downstroking stiffness of 870 kn/m.

During emergencies, the deck support system is designed to operate at the required tension ranges using only eleven of its twelve support cylinders 124. With pressures adjusted, this approach ensures that when only eleven cylinders are operating, full system tension can be supported without exceeding the maximum rated design pressure of 21.42 MPa at the full downstroke position. The cylinder bore size is selected to optimize the pressure rating of the cylinder per unit weight of the tensioner element. The deck structure and cylinder attachment locations are designed to minimize deflections allowing smooth vertical motion of the deck even with one cylinder out of service.

Figure 12:
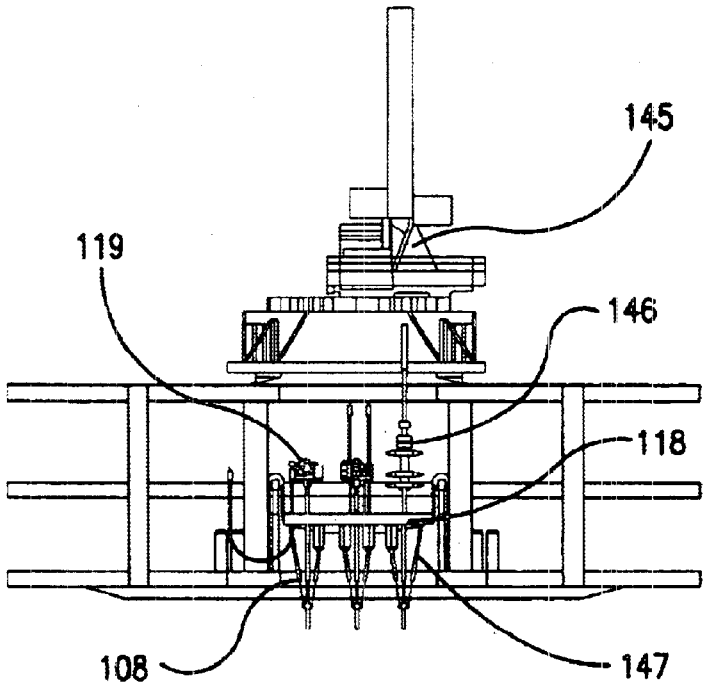
FIG. 12 is a side view showing the use of a workover rig.

The Xmas tree deck 118 can be designed to lock off at specific elevations during normal operation, thereby becoming a very stable work platform for installation or maintenance work (see FIG. 12). A workover rig 145 can operate through a BOP 146, and the Xmas tree deck acts as a support for a drilling riser tensioner 147. The vacant centrally located slots 109 or 110 can be used for workover, and the substructure can be moved so that the respective slot is directly over the sub-sea well.

The HF and LF systems operate in combination to cover all ranges of platform and riser induced motions. With the LF system initialized in the heave compensator 117 and Xmas tree deck 118 null positions, the total amount of riser vertical downstroke is 7.01 m, and 5.48 m is available for riser upstroke. Therefore, the total range of usable riser motions, relative to the DDF, for the deck system is 12.49 m.

The combined riser tensioning system operates in a completely passive mode if a platform is abandoned during extreme environmental conditions. Hydraulic control as an override is desired for specific operations, such as platform maintenance, wellhead tree installations and extreme tide adjustments. The preferred passive operation of tensioning system is accomplished by tuning the HF and the LF systems such that they work close to identical spring characteristics. The heave compensators 117 combined will then have the same stiffness as the Xmas tree deck support cylinders 124. Since the HF heave compensators 117 each consist of an array of four individual cylinders 108, the motion compensation will in most cases be picked up by these heave compensators in isolation without requiring the Xmas tree deck 118 to move. This is because, for a floater like a DDF or a Spar, there will always be some element of pitch in addition to the heave pay-out. This will result in less overall force combined from the heave compensators, as they will break out from sticktion at an earlier point in time. Hence the Xmas tree deck will be the last object to move when there is a riser pay-out or pay-in situation.

Internal cylinder cushions installed in the heave compensators will rapidly increase the HF stiffness as the cylinders approach the end of their stroke range. This will create a rapid rise in force acting on the entire Xmas tree deck 118. The force will overcome the LF sticktion and spring resistance, and drive the deck 118 up or down during extreme displacement situations. Normally a limited number of heave compensators 117 will reach into their hardening zone, as there always will be some pitch differential across the deck. The corresponding risers 116 will be subject to some short duration increase in riser tension which will cause the required additional force to move the deck as mentioned above.

When there are operational requirements to re-position the Xmas tree deck 118 at specific elevations, active control of the deck is necessary. Various methods to control the cylinders 124 of the deck adjustment system have been examined. One such method is to put a hydraulic pressure precharge in the cylinders 124 when setting up the system in the preferred null operating position. By pumping fluid in and out of the cylinders, lowering or raising of the deck 118 can be achieved.

Additional sophistication to the control system might include a PLC program that automatically adjusts the elevation of the Xmas tree deck 118. Rod stroke measuring devices would be installed on selected heave compensators 117 and deck support cylinders 124. The PLC would monitor the stroke position of the heave compensator cylinders, and, when the cylinders reach preset stroke out or stroke in limits, the PLC would drive the Xmas tree deck in the required direction by pumping fluid into the deck support cylinders. In addition, pressure in all cylinders can be monitored and compared. If rapid pressure drops or cylinder motions are recorded, (relative to other cylinders), alarms will indicate where to perform system checks.

Figure 13:
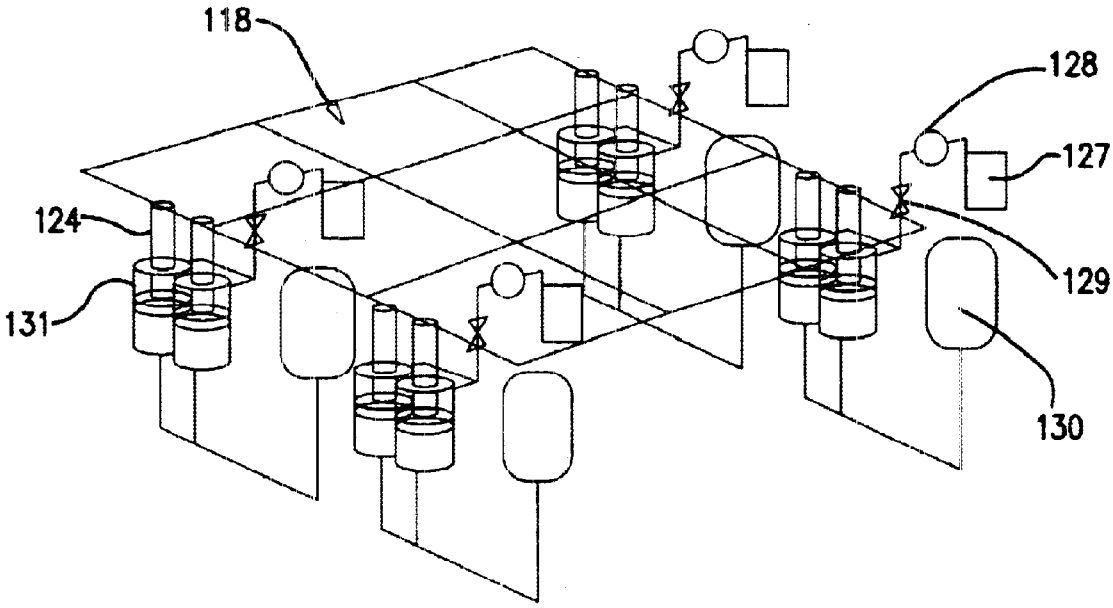
FIG. 13 is a diagrammatic view showing operation of the system.

The control system philosophy is illustrated in FIG. 13. An Xmas tree deck 118 is supported on four pairs of hydraulic cylinders 124, comprising the LF compensation system. Each pair of cylinders is supplied from a reservoir 127 through a pump 128 and precision control valve 129. The inactive (lower) ends of each pair of cylinders are linked to an accumulator 130 and constitute the passive system that balances the self-weight and riser loads on the Xmas tree deck 118.

There is also a marginal overload on the system which is counteracted by the pressure in the active system in the annulus 131 (above the piston). Margins are set so that there is always a positive over pressure in each annulus. Hence the passive system acts as a pre-compressed spring. Vertical movement of the deck 118 is effected by the active system through the precision control valves. Any loss or failure of the active system leads to a release of the active pressure from the annulus, so that the system becomes wholly passive. An effect of this arrangement is that the risers are slightly overtensioned.

To set the system deliberately in passive mode, the active system is deactivated. The heave compensators 117 of the HF system have increased spring rates at the ends of their strokes. The Xmas tree deck 118 is moved by the heave compensators 117 reaching the ends of their strokes.

Figure 14:
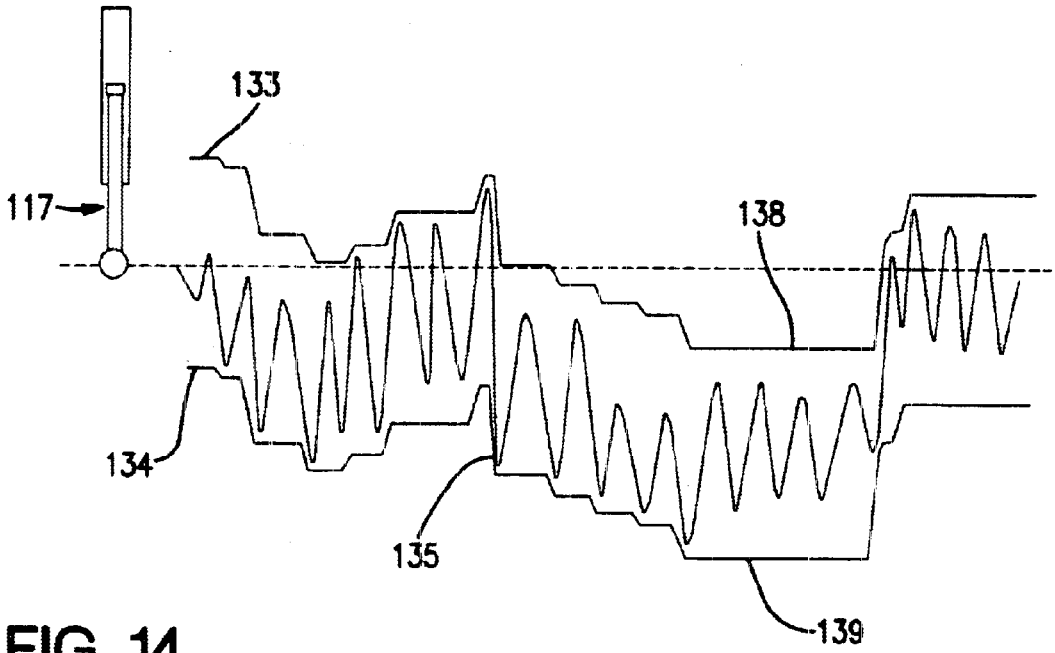
FIGS. 14 and 15 are disturbance/time graphs illustrating operation of this embodiment.
Figure 15:
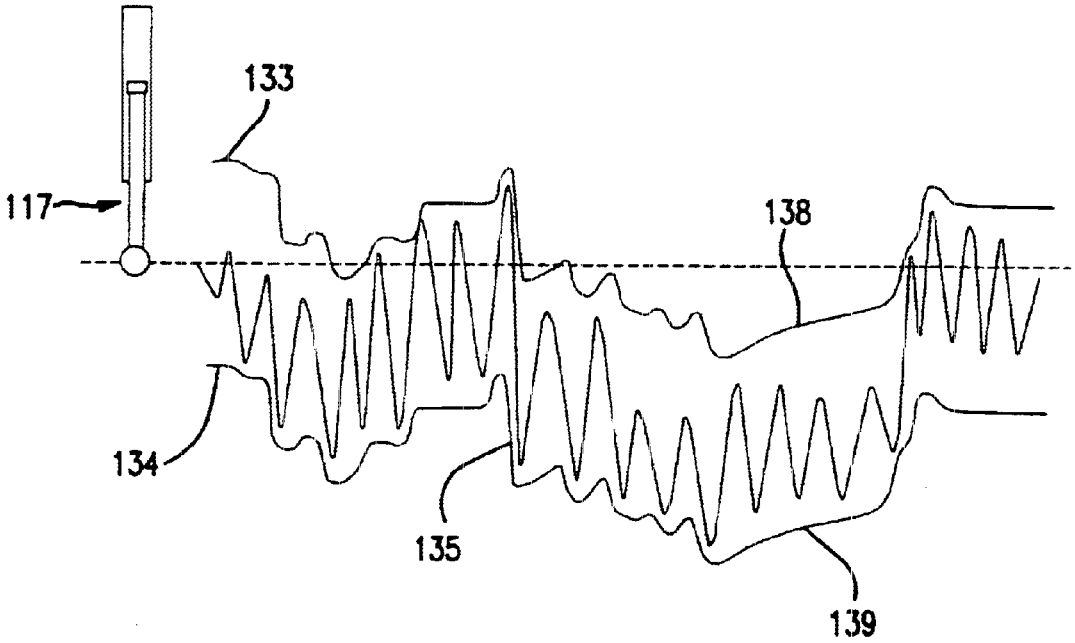

Typical time histories are shown in FIGS. 14 and 15 (with vertical motions of the risers exaggerated). FIG. 14 shows a trajectory of riser/substructure heave and Xmas tree deck displacement with controlled friction force. The entrapped curve is the relative heave between substructure and riser, while upper and lower curves 133/134 are overlaid Xmas tree deck movements. The lower overlaid curve shows, for illustrative purposes, the interaction of the heave compensator stroke-out limitation and the resulting Xmas tree deck downward acting response. The upper overlaid curve shows the corresponding up-stroke interaction. FIG. 15 shows a similar trajectory in a low friction mode. (Reference numerals correspond with those in FIG. 6.) As long as the stroke is within the capacity of the heave compensator, the Xmas tree deck remains static (FIG. 14) or drifts towards nominal equilibrium (FIG. 15). The effect of large substructure pitch or heel angles will lead to Xmas tree deck motion responses at an earlier stage than compared to an upright position of the substructure. (A larger part of the "average" stroke will be taken by the Xmas tree deck adjustment system).

Response of a floating substructure to a seastate may be 'tuned' by locking off one of the systems to harden the heave stiffness. With the Xmas tree deck locked in position there is a high spring rate (very hard spring). By releasing all the constraints, the spring rate is lowered to give a very soft spring. Typically, locking all the deck cylinders gives a global stiffness of 875 kN/m, while opening all the cylinders gives a global stiffness of 1437 kN/m. In this way the platform eigenvalue in heave may be adjusted by several seconds. This may be particularly effective for DDFs and semisubmersibles, for which the waterplane stiffness is small. Increasing the spring stiffness adds to the waterplane area stiffness. Fine weather would have a stiff system, and rough weather would have a softer system.

ADVANTAGES OF THE INVENTION

The systems described by way of example have several potential benefits.

The two tier riser tensioning system is an appropriate approach for solving the riser tensioning problem in deep to ultra deep waters. By applying the HF/LF philosophy one may design a versatile system with substantial user friendliness and safety features, even in the abandoned case.

The system is very compact and fits easily into a traditional substructure with drilling on top. Work-over and installation operations may benefit from the adjustable Xmas tree deck feature. Gaining access to the individual production trees becomes much easier as the height of access platforms above the Xmas tree deck will be moderate at all times. Inspection of the tensioner rings may be performed in moderate weather by simply lowering the deck into max down stroke position. By cutting stroke lengths in half, the two tier system becomes significantly more cost effective than single stroke systems. It may also challenge the cost of buoyancy can systems.

The requirement for long stroke heave compensators is eliminated. The proposed system contains its own provisions for redundancy, to account for partial failures within the system. The proposed system can be self controlled in a stable state, and can be arranged to work on its own with simple mechanical control devices.

The proposed system uses proven technology. The heave compensators are already available for drilling risers used in drill ships operating in water depths of 3,000 m. A typical weight of 1,400 Tonnes could be compensated on a single stroke wire sheave system.

What is claimed is:

1. An arrangement to tension a plurality of risers extending from a sea bed up to a substructure for a floating oil/gas drilling/production platform, the arrangement comprising a conventional hydraulic tensioner/heave compensator for each riser in which there is a soft spring formed by a piston cylinder combination acting against an accumulator, the heave compensators for the risers being disposed to compensate for vertical oscillations of relatively short period between the risers and a Xmas tree deck which supports the heave compensators, wherein there is a vertical position adjustment system having means for intermittently adjusting a vertical position of the Xmas tree deck as a whole relative to the floating substructure, in order to compensate for longer term changes which would otherwise cause individual ones of the riser's tension or stroke position to depart from a predetermined target value/range;

the Xmas tree deck being normally disposed at one particular position within its range of movement to compensate for the longer term changes, such that the heave compensators form a first stage of a two stage heave compensation system, and the vertical position adjustment system forms the second stage of the two stage heave compensation system.

2. An arrangement as claimed in claim 1, in which the vertical position adjustment system includes stiff hydraulics which interconnect the Xmas tree deck and the substructures.

3. An arrangement as claimed in claim 2, in which hydraulic oil is supplied from pressurized accumulators when raising the Xmas tree deck and bled to a tank when lowering the Xmas tree deck.

4. An arrangement as claimed in claim 1, in which the Xmas tree deck has counterbalance means such that its vertical movements to compensate for longer term changes are counterbalanced, and only minimal force is required to effect vertical movement.

5. An arrangement as claimed in claim 4, in which the Xmas tree deck vertical position adjustment system comprises at least three piston cylinder and accumulator combinations acting between the Xmas tree deck and the floating substructure and in which the three combinations are synchronised to avoid excessive tilt of the Xmas tree deck relative to the substructure.

6. An arrangement as claimed in claim 5, in which the cylinders in the combinations are connected to a single accumulator so that the Xmas tree deck is sensibly horizontal, and in which there is a rack and pinion mechanism which engages with the substructure to maintain parallellity of the moving Xmas tree deck with the substructure at all times, where rack and pinions engage at least two faces of the deck, at right angles.

7. An arrangement as claimed in claim 4, in which the vertical position adjustment system comprises at least three pulley systems acting between the Xmas tree deck and the substructure and in which the pulley systems are powered to compensate for longer term vertical changes.

8. An arrangement as claimed in claim 7, in which a part of each pulley system is engaged by a further piston cylinder combination.

9. An arrangement as claimed in claim 7, in which the pulley systems are powered by hydraulic or electric motors for synchronous movement.

10. An arrangement as claimed in claim 4, in which there is means whereby synchronism can be effected by hydraulic valve logic while the vertical position adjustment system is moving.

11. An arrangement as claimed in claim 4, in which a locking provision on the vertical position adjustment system is arranged to become unlocked when a heave compensator is approaching the end of its stroke.

12. An arrangement as claimed in claim 11, in which predetermined high and low pressures in the heave compensators are arranged to open valves between the piston cylinder combinations and the accumulators in the vertical position adjustment system.

13. An arrangement as claimed in claim 1, in which the vertical position adjustment system includes mechanical engagement devices which interconnect the Xmas tree deck and the substructure.

14. An arrangement as claimed in claim 1, in which there is a control system including means to control the arrangement to operate without human intervention.

15. An arrangement as claimed in claim 14, in which the control system includes means to adjust the elevation of the Xmas tree deck in response to stroke measuring devices on at least three of the individual heave compensators, whereby, at preset limits of compensator stroke, the vertical position adjustment system moves the Xmas tree deck in a sense towards the limit reached on the individual heave compensator.

16. An arrangement as claimed in claim 14, in which the individual heave compensators have increased spring rates near both the limits of travel of the individual heave compensators, whereby the equilibrium of the balanced Xmas tree deck will be changed such that the Xmas tree deck moves towards the applicable limit of travel under the action of the vertical position adjustment system.

17. An arrangement as claimed in claim 1, in which there is means acting on the balanced vertical position adjustment system under mean force equilibrium such that the Xmas tree deck is normally retained by frictional forces in one particular position within its range of movement, and is moved intermittently in direct response to one or several of the heave compensators approaching a limit of operation.

18. An arrangement as claimed in claim 17, in which hydraulic cylinders in the vertical position adjustment system are pre-pressurised, so that the system acts as a pre-compressed spring which fails to 'safe' if the active drive systems lose pressure.

19. An arrangement as claimed in claim 18, in which the heave compensators have an increased vertical spring stiffness as they approach the ends of their stroke ranges.

20. An arrangement as claimed in claim 17, in which there is adjustment means to change the characteristics of individual heave compensators, so that both the heave compensators for the risers and the vertical position adjustment system for the Xmas tree deck approach their limits of operation at the same time.

21. An arrangement as claimed in claim 1, in which the Xmas tree deck has an integral deck centralisation system.

22. An arrangement as claimed in claim 21, in which the Xmas tree deck is supported on at least four pairs of vertical position adjustment systems disposed generally symmetrically about the deck, and the adjustment systems have means to centralise the deck within a generally horizontal aperture in the substructure, such that individual heave compensators react lateral loads from individual risers into the Xmas tree deck, and the Xmas tree deck as a whole is centralised within the horizontal aperture.

23. An arrangement as claimed in claim 22, in which vertical rods guide the Xmas tree deck within the horizontal aperture.

24. An arrangement as claimed in claim 22, in which projections from the Xmas tree deck engage vertical guide rails surrounding the horizontal aperture.

25. An arrangement as claimed in claim 22, in which there are pinions on the Xmas tree deck arranged to engage vertical racks round the horizontal aperture.

26. An arrangement as claimed in claim 25, in which resilient means are disposed to hold the pinions in engagement with the racks.

27. An arrangement as claimed in claim 1, in which the vertical position adjustment system for the Xmas tree deck has a generally central slot occupied by drillstring riser tensioner, so to facilitate drilling/workover.

28. An arrangement as claimed in claim 27, in which the Xmas tree deck is used as a foundation for a drilling riser tensioner.

29. An arrangement as claimed in claim 27, in which the Xmas tree deck is used as a foundation for a workover drillstring tensioner.

30. An arrangement as claimed in claim 1, in which hoses from individual Xmas trees on the Xmas tree deck are led through individual downwardly opening trumpet sleeves dependent from a platform above the Xmas tree deck.

31. An arrangement as claimed in claim 1, and consisting of several individual bays of deck grid systems placed onboard the substructure to reduce the pitch differential across the riser array.

32. An arrangement as claimed in claim 1 in which there is provision to lock off the vertical position adjustment system for the Xmas tree deck, whereby to adjust the vertical heave stiffness of the substructure.

33. A substructure for a floating oil or gas production platform, including an arrangement as claimed in claim 1.

34. A method of controlling the tension in risers extending from the sea bed up to the hull of a substructure for a floating oil or gas production platform, using the arrangement as claimed in claim 1.

* * * * *

UNITED STATES PATENT AND TRADEMARK OFFICE

CERTIFICATE OF CORRECTION

PATENT NO. : 6,691,784 B1
DATED : February 17, 2004
INVENTOR(S) : Leiv Wanvik

It is certified that error appears in the above-identified patent and that said Letters Patent is hereby corrected as shown below:

Title page,
Item [73], Assignee, should read as follows:
-- [73] Assignee: Maritime Hydraulics AS, Kristiansand (NO) --.

Signed and Sealed this

Eighteenth Day of May, 2004

JON W. DUDAS
*Acting Director of the United States Patent and Trademark Office*